US005730319A

United States Patent [19]

Gray et al.

[11] Patent Number: 5,730,319

[45] Date of Patent: Mar. 24, 1998

[54] BUSINESS CARD DISPENSER

[75] Inventors: Kenneth M. Gray, San Marcos, Calif.; Michael J. Duly, 6352-C Corte Del Abeto, Carlsbad, Calif. 92009

[73] Assignee: Michael J. Duly, San Diego, Calif.

[21] Appl. No.: 404,964

[22] Filed: Mar. 16, 1995

[51] Int. Cl.[6] ..... G07F 11/20

[52] U.S. Cl. ..... 221/259; 221/58; 221/232; 221/268; 221/270

[58] Field of Search ..... 221/58, 232, 259, 221/267, 268, 270; 206/39.4, 39.5

[56] References Cited

U.S. PATENT DOCUMENTS

| | | | |
|---|---|---|---|
| 231,863 | 8/1880 | Strattan | 206/39.5 |
| 476,005 | 5/1892 | Davis | 206/39.5 |
| 922,272 | 5/1909 | Garrod | 206/39.4 |
| 930,619 | 8/1909 | Russell | 221/259 |
| 1,011,981 | 12/1911 | McCulloch | 221/259 |
| 1,016,779 | 2/1912 | Ruppel | 221/259 |
| 1,056,809 | 3/1913 | McColloch | 221/259 |
| 1,086,384 | 2/1914 | McKinnon | 206/39.4 |
| 1,131,112 | 3/1915 | Brown | 221/259 |
| 1,309,173 | 7/1919 | Baker | 221/259 |
| 1,326,926 | 1/1920 | Gray | 221/259 |
| 1,598,266 | 4/1926 | Davis | 221/259 |
| 1,697,366 | 1/1929 | Oppergelt | 221/232 |
| 2,216,476 | 10/1940 | Mutz | 221/232 |
| 2,311,173 | 2/1943 | Hill | 221/259 |
| 2,348,303 | 5/1944 | Muros | 221/232 |
| 2,637,609 | 5/1953 | Berg | 221/259 |
| 3,133,672 | 5/1964 | Thomasma et al. | 221/259 |
| 3,827,597 | 8/1974 | Braginetz | 221/232 |
| 3,957,175 | 5/1976 | Gordon | 221/267 |
| 4,653,666 | 3/1987 | Mertens | 221/58 |
| 4,887,739 | 12/1989 | Parker | 221/232 |

OTHER PUBLICATIONS

4792058 Dec. 1988 Parker 206 39.4.

524415 Sep. 1993 Huck 221 259.

*Primary Examiner*—William E. Terrell
*Assistant Examiner*—Khoi H. Tran

[57] ABSTRACT

An improved business-person's holder and hygienic seeming dispenser for standard business-cards, constructed as to provide novel convenience advantage of dispensing outward from one of the long-sides of a rectangular housing, by biasing of a dispensing button forward from a rearward ready position. The notion of the invention being to keep the cards of virtually any gauge-thickness hygienically clean and wrinkle-free, while providing a repetitively reliable rapid-action, and relatively elegant modality by which to introduce oneself to others. A novel actuator-mechanism is included wherein by virtue of thumb-pressure applied to the dispensing button it thereby simultaneously tilts-over slightly as to lower a close-coupled friction-pad down upon the upward-face of uppermost card stacked into the housing. The uppermost card is thus frictionably transported away from the remaining stack, to an outwardly position exhibiting about 80% of the card's face to the customer to which it is being presented. If not taken, the card may be pushed manually back into original aftward ready position upon release and spring-return of the dispensing button to it's normally aftward position. A preferably hinged rear access-lid is provided by which to conveniently refill additional cards within the metal or plastic case as necessary; wherein plural cards are simply inserted between a spring-loaded pressure-platen having a chamfered mouth for easy insertion there between the ceiling-surface of the containment chamber.

5 Claims, 1 Drawing Sheet

FIG.~1
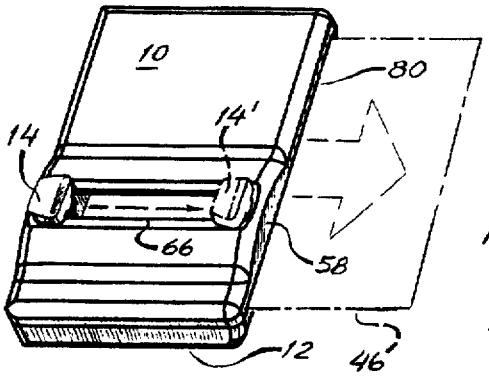
FIG.~2
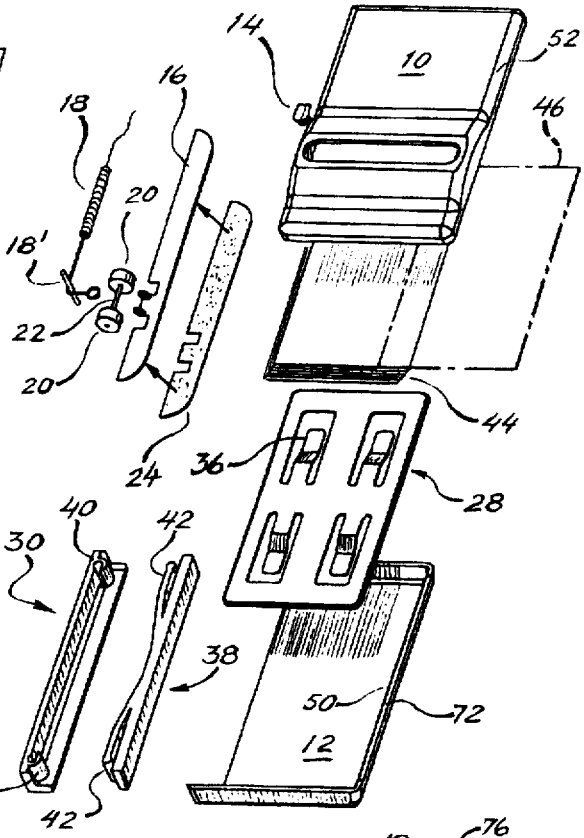
FIG.~3
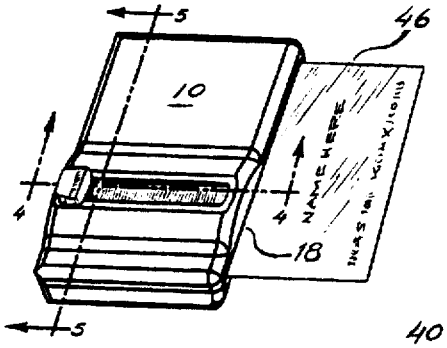
FIG.~4
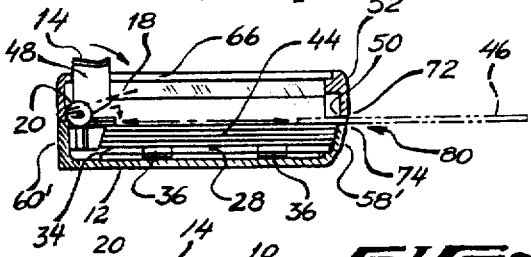
FIG.~5
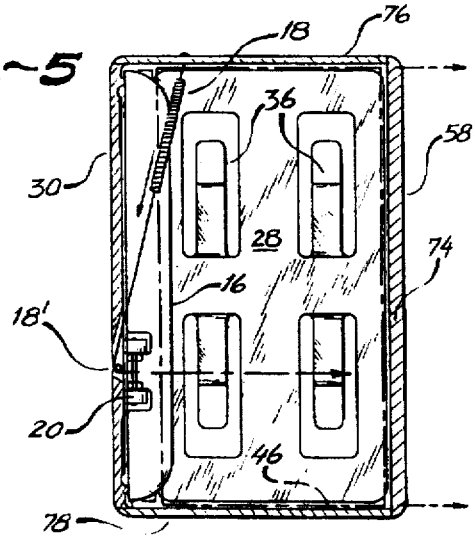
FIG.~6
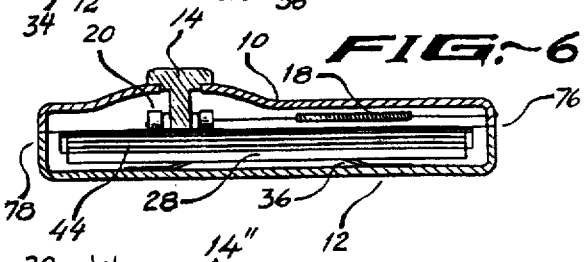
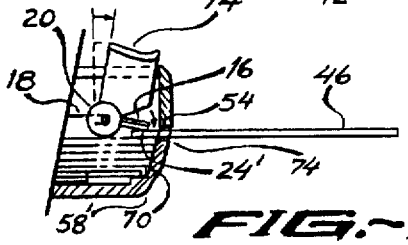
FIG.~7
FIG.~8
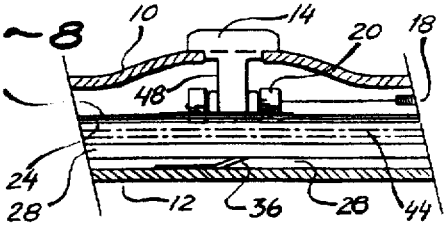

BUSINESS CARD DISPENSER

BACKGROUND—FIELD OF INVENTION

The present invention relates to business card dispensers and the efficiency with which business cards are dispensed, the direction business cards are dispensed, the amount of business card that is exposed after dispensing, and the ability to correctly present business cards, as required by some cultures such as Japan.

Business cards are generally carried to distribute to business contacts or to personal acquaintances. A supply of business cards has been kept in wallets, pockets, briefcases or other types of card cases. None of these devices are convenient nor do they make the process of exchanging business cards very graceful. Business cards are hard to present quickly and become dirty and generally unpresentable very quickly if they are unprotected. All offerings of card dispensers to date, do not present enough of the business card so it might be read before the business card is accepted. Most offerings to date have been inconvenient and could cause damage to ones' trousers pockets, breast pockets, pocket books and or other storage areas, with their sharp edges.

BACKGROUND—DESCRIPTION OF PRIOR ART

While there have been a number of business card dispensers designed (644,148, 1900; 1,656,615, 1928; 5,069,333, 1991; and CARD MAN, patent pending), none of these dispense the card from the side nor offer the convenience as a matter of design or function. It is not clear just how much of the card is presented in the early (1928) patent, however, it can be taken for granted that the exposed business card could not be in the 80 to 90% range. This is due to the trailing hook design and the amount of travel needed to expose 80 to 90% of a business card and is not provided for in this type of design. This became evident when reviewing the CARD MAN, which uses the trailing hook design. This product delivers only about 10% of the business card. The latest (1991) patent also limits the amount of exposure, in that the finger travel is limited by the hole provided in the top cover. This design does not use the side of the case to dispense cards but to store received business cards.

We can see no prior art in the use of the incline plane as a helpful means to start the business card delivery process. One of the latest (1991) patents uses incline surfaces to help the dispensing once the business card has traveled past the initial business card opening (of 34 and 36 as can be seen in FIG. 3, patent 1991 ). None of the prior arts shows the use of a roller for improved withdrawal of the dispenser delivery system in preparation for delivery of the next business card.

We find no prior art using a spring tensioning system to position business cards to the front incline plane which helps cause the business cards to release when engaged by the friction pad. This same tensioner also makes automatic adjustment for different sized business cards, this is required by the wide variation in card width.

Clearly there has been an unfulfilled need to easily and gracefully dispense and present business cards for reading before acceptance. This proper presentation is particular interest to some cultures such as Japan.

OBJECTS AND ADVANTAGES

Accordingly, several objects and advantages of this invention are: efficient business card dispensing; dispensing business cards from the side, providing not less than 80% of the card exposed; correct presentation of the card for reading; keeps cards clean and presentable; automatically adjustment for a wide range of business card widths. It also provides for the opportunity, for some cultures to properly present business cards, to acknowledge the level of importance of the presenter before the card is accepted.

This invention provides a convenient size, ease in dispensing, convenience of visibility of the business cards when dispensed so they might be read before acceptance, ease in business card loading, smooth delivery, clean business cards which are without wrinkles, soft smooth edges which greatly reduce the chance of pocket damage resulting from the sharp edges on some of other offerings.

Still further objects and advantages will become apparent from a consideration of the ensuing description and accompanying drawings.

BRIEF DESCRIPTION OF THE DRAWINGS

FIG. 1 is a overall perspective view showing the complete outside of the card dispenser FIG. 2 shows a perspective exploded view of FIG. 1 with all parts exposed FIG. 3 is a similar perspective to FIG. 1 showing all the parts, both internal and external FIG. 4 is a sectional view of FIG. 3, indicated by cut lines 9—9, as assembled FIG. 5 is a sectional view of FIG. 3, as indicated by cut lines 8—8, as assembled FIG. 6 shows a top view with all assembled parts as seen in FIG. 2

FIG. 7 shows an enlarged partial section of FIG. 4, at the card delivery opening FIG. 8 shows an enlarged partial section of FIG. 5, at the dispensing button

Reference Numerals

10 top cover
12 case bottom
14 dispensing button
16 friction retainer
18 friction retainer return spring
20 card roller return
22 card roller shaft
24 friction pad
26 guide rails (not shown)
28 card tray
30 rear door
32 tray tensioning arms
34 business card insertion means
36 engagement tensioning arms
38 rear tensioner
40 rear retainer
42 rear tensioner arms
44 business cards
46 business card
48 stem
50 ledge
52 top cover side
54 top incline
58 front top
60 front bottom
66 button glide slot 70 incline plain
72 card open top
74 card opening bottom

SUMMARY

A smooth, quick and efficient means of dispensing business cards. One that dispenses cards from the side and presents a majority of the business card. This is such that if the business cards were of normal design, designed to be read from the side (left to right across the width and not the length) so that the business card might be read before it is taken. Alternate designs could be available that provide for business cards that are laid out in the opposite direction and would dispense cards out the end, i.e. lengthwise.

PREFERRED EMBODIMENT—DESCRIPTION

Referring to the drawings, and particularly to FIG. 1, a business card dispenser is shown according to a preferred embodiment. The embodiment generally comprises a top cover 10, and a case bottom 12, fixed together, forming an inner chamber. The top cover 10, and case bottom 12, holds a number of parts, as will further be explained in the following paragraphs where they can more reasonably be explained.

Now referring to FIG. 2, which is similar to FIG. 1 except, it shows the components exploded for a better presentation of parts that are associated together and described as follows:

The top cover 10, holds the dispensing button 14, which passes through the button guide slot 66, by means of the stem 48, which joins the dispensing button 14, and the friction retainer 16, and the friction retainer return spring 18. The friction retainer 16, holds the card roller return 20, card roller shaft 22, and the elongated friction pad 24. These components; the dispensing button 14, button guide slot 66, stem 48, friction retainer 16, friction retainer return spring 18, card roller return 20, card roller shaft 22, and the friction pad 24, are used for dispensing business cards and reset for the next business card dispensing. The top cover 10, may have guide rails 26 (not shown), that may guide the friction retainer 16.

The case bottom 12, is composed of the following; card tray 28, and a separate removable rear door 30. Also can be seen as part of the card tray 28, are the tray tensioning arms 32, engagement tensioning arms 36, and a business card insertion means 34.

The rear door 30, retains the; rear tensioner 38, by means of rear retainer 40, which confines the rear tensioner arms 42, which holds the rear tensioner 38. These components; card tray 28, tray tensioning arms 32, engagement tensioning arms 36, rear door 30, rear tensioner 38, rear tensioner arms 42, help convey the business cards upward and forward toward the ledge 50 (refer to FIG. 5) and the card opening, top and bottom, 72, and 74.

It is these components; ledge 50 (refer to FIG. 5), top incline 54 (refer to FIG. 7), all part of the top cover 10, the case bottom 12, with the incline plane 70, card tray 28, rear door 30, tray tensioning arms 32, engagement tensioning arms 36, rear tensioner 38, rear retainer 40, and the rear tensioning arms 42, when combined together assist the delivery of business card 46, and make them ready for dispensing.

Now referring to FIG. 3, it can be seen that it is the same as FIG. 1, except it shows both the external and internal parts, and all the pads included in FIG. 2, as assembled and includes a stack of business cards 44. Also shown are cut sections 8—8 and 9—9 for FIGS. 4 and 5.

Now referring to FIGS. 4, 5, and 7, it can be seen more clearly how the parts are assembled and work together. This may not have been as clear as seen in FIGS. 1, 2, or 3. In FIGS. 4, and 5, it can be seen how the dispensing button 14, friction retainer 16, friction retainer return spring 18, card roller return 20, card roller shaft 22, and the friction pad 24, are contained in the top cover 10, by means of the button guide slot 66 (refer to FIGS. 1 & 2), and the joining stem 48. These parts; the dispensing button 14, friction retainer 16, are joined together by a stem 48, and fit loosely to the top cover 10, so they; the dispensing button 14, and friction retainer 16, may move up and down, slightly, with some freedom. This up and down movement is a required part of dispensing business card 46, and the return of the dispensing button 14, and the associated parts; friction retainer 16, friction retainer return spring 18 (not shown), friction retainer 16, card roller return 20, card roller shaft 22, and the friction pad 24, to the start position, ready for the next business card 46 to be dispensed.

The business cards 44, are captured between ledge 50, located as part of the top cover 10, and runs on the bottom of the top cover 10, down the width of the top cover side 52, and the front top 58, and the force exerted by the card tray 28, which results from both the tensioning arms 32 and the engagement tensioning arms 36 This ledge 50, turns into a top incline 54, at the card opening top 72, located in the top cover 10, at the front top 58, where the business card 46, is dispensed through the card opening bottom 74, located in the case bottom 12, at the front bottom 60. This top incline 54, helps to encourage business card 46, to move out the card opening, top and bottom 72 and 74, as forward pressure is caused by the friction pad 24, by urging the dispensing button 14, forward. This can be seen more clearly in FIG. 7, the enlarged section of the card opening, both top and bottom, 72, and 74.

FIG. 6, shows the dispensing button 14, and button glide slot 66, through which stem 48 (refer to FIG. 5), passes and joins the friction retainer 16, to the dispenser button 14. Also shown are the rear tension arms 42, and the connection of rear tensioner 38, to rear door 30, by means of the rear retainer 40. When the rear door 30, is removed from the case bottom 12 (refer to FIGS. 1, 2, 3, 4 and/or 5), business cards 44, can be easily installed into the case bottom 12 (refer to FIGS. 1,2, 3, 4 and/or 5), by passing over the card tray 28 (refer to FIGS. 2, 3 or 4), and over the business card insertion means 34. After business cards 44, are installed into the case bottom 12 (refer to FIGS. 1, 2, 3, 4 and/or 5), they are held captive between the top cover 10, ledge 50 (refer to FIG. 5), card tray 28, tray tensioning arms 32, along with the engagement tensioning arms 36, rear tensioner 38, supported by the rear tensioning arms 42.

FIG. 7 shows a business card 46, positioned ready for delivery, which is limited by ledge 50, which is part of the case top 10, and passing through the delivery opening, top and bottom 72, and 74. This action is supported by the incline plane 70, of the case bottom, and is further helped by the reduced pressure caused by the relief of ledge 50, into a gentle slope of the top incline 54. It is this combination of forces and incline surfaces, coupled with the forward and downward force of the friction pad 24, which results in the card moving forward and out the opening, bottom and top 72, and 74.

PREFERRED EMBODIMENT—OPERATION

The business cards 44, are dispensed, one business card 46, at a time, as a result of a combination of forces and friction, caused by the following: (1) The result of the upward force of the tray tensioning arm 32, engagement tensioning arm 36, upon the card tray 28, which pushes business cards 44, up against ledge 50, of the top cover 10, further forward pressure is the result of the rear tensioning arms 42, up against the incline plane 70, located in the case bottom 12. The sum results of both the upward force against ledge 50, and the forward force of the rear tensioner 38, against the incline plain 70, that position the business card 46, ready for dispensing. (2) The result of the card roller return 20, making contact with business card 46, after the dispensing button 14, is pushed down lightly and forward with a finger, tilts the friction retainer 16, and the friction pad 24, forward, causing with further forward motion the business card 46, to move forward. It is this downward and forward motion, and slight rotating clockwise motion of the complete assembly of the; dispenser button 14, friction retainer 16, friction pad 24, card roller return 20, roller shaft 22, and the retainer return spring 18 (not shown), bring the friction pad 24 in direct contact with business card 46, urging it forward and out of the dispenser until 80 to 90% of the business card 46, is exposed and ready for presentation, through the card opening, top and bottom, 72, and 74.

With the reverse action, caused by the retaining return spring 18, the dispensing assembly; dispenser button 14, friction retainer 16, friction pad 24, card roller return 20 and roller shaft 22, move rearward and cause the assembly to rotate slightly counter-clockwise, bringing the card return roller 20, in contact with the next business card 46, which causes the card roller return 20, to roll freely and return to the ready position, in direct contact with the business card 46. The dispenser is now ready to dispense the next business card 46.

It should be further noted that this invention, and more directly the business card delivery system; the dispenser button 14, friction retainer 16, friction pad 24, card rolled return 20, roller shaft 22, caused by the retaining return spring 18 is designed to deliver and present the majority of the business card 46, via the side dispensing system, as illustrated. If the cards were of standard design, it could be read before being accepted. This is of particular interest in such countries such as Japan. In such cultures the presentation or exchange of business cards is a ceremony and a tradition. The card is read so that the receiver might know how far to bow as a sign of respect to the presenter.

It should also be noted that this design and invention could also dispense cards out the end as shown in other patents and prior art, and should not limit this patent in any manner as it still remains unique based on the delivery system. It is also conceivable that the business card delivery system could be electronic in nature.

Conclusions, Ramifications, and Scope

Accordingly, it can be seen that the business card dispenser provides a number of answers to problems that now exist in the present and past designs of business card dispensers: (1) It provides a smooth and fluid means to present a business card 46. (2) It presents enough of the business card 46, so it might be read before it is accepted, (3) It is smooth and free of sharp edges. Business cards 44, can be inserted easily through the rear door 30. Business cards 44, are separated from the top cover 10, and the case bottom 12, by the smooth light forward motion of dispensing button 14, causing the friction pad 24, to engage the business card 44, urging it forward and out the card opening, both top and bottom 72, and 74. The incline plane 70, and the top incline 54, urge the cards forward and out the card opening, top and bottom 72, and 74, making the business card 44, easy to retrieve and or read. All business cards are securely retained, free from damage and wrinkles, until they are dispensed.

The design of the present invention is particularly useful when handing out business cards to first time contacts by impressing them with the efficiency of the dispensing and by the fact that the card can be read before it is taken. This is of particular interest in such countries such as Japan, where the exchange of cards is a ceremony steeped in tradition.

Although the description above contains many specificities, these should not be construed as limiting the scope of the invention but as merely providing illustrations of some of the presently preferred embodiments of this invention. Various other embodiments and ramifications are possible within the scope. For example, use of similar means: (1) To dispense the card out the end or lengthwise; (2) Dispensing the same through an electrical means; (3) Slight modification in the details, especially in the matter of shape and size and arrangement of parts within the principles of the invention to the full extent indicated by the broad general meaning of the terms in which the appended claims are expressed.

Thus the scope of the invention should be determined by the appended claims and their legal equivalents, rather than by the examples given.

What is claimed is:

1. A pocket-portable business-card hygienic dispensing apparatus facilitating convenience of semi-automatically offering individual cards to others, while not personally touching the card; said apparatus comprising:

a rectangular housing adapted to hold conventional business-cards, with a top, a bottom, a front-wall, a rear-door, and two laterally opposed side-walls, including a dispensing-slit arranged between said front-wall and said top;

a spring loaded card-tray located within said housing for supporting a stack of cards;

a guide-slot formed into said top and extending parallel proximal the length of said side-walls, including a thumb operated dispensing-button acting slidingly within said guide-slot;

a friction-pad jointedly attached under said dispensing-button and arranged parallel to said front-wall so as to extend across widest dimension of said cards, and including a card-roller, arranged integrally beneath said dispensing button;

a manually exerted down and forwardly directed force applied upon said dispensing-button by user, lands said card-roller upon a surface of a topmost card, tilting said friction-pad downwardly forward and frictionally impinging a friction-pad leading edge upon said card's surface, and thereby urging said topmost card outward via said dispensing-slot;

a return-spring attached to said dispensing-button, restoring said dispensing-button and card-roller back to original position subsequent to each individual dispensing sequence, for repeat action.

2. A pocket-portable business-card dispenser per claim 1, wherein said front-wall is significantly longer than said side-walls.

3. A pocket-portable business-card dispenser per claim 1, wherein said friction-pad and integral card-roller are attached to said dispensing-button via a friction-retainer.

4. A pocket-portable business-card dispenser per claim 1, wherein said front-wall includes an inclined-plane for more smoothly guiding said cards upwardly.

5. A pocket-portable business-card dispenser per claim 1, wherein a rear-tensioner is located in the vicinity of said rear-door, thereby pushing said cards forward.

* * * * *